US007096509B2

(12) United States Patent
Kim

(10) Patent No.: US 7,096,509 B2
(45) Date of Patent: Aug. 29, 2006

(54) TIE AND SHIRT COMBINATION SECURED WITH AN ELASTIC BAND

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 98 days.

(21) Appl. No.: 10/763,410

(22) Filed: Jan. 23, 2004

(65) Prior Publication Data

US 2005/0160515 A1 Jul. 28, 2005

(51) Int. Cl.
*A41D 25/04* (2006.01)

(52) U.S. Cl. ..... 2/145; 24/49.1; 206/278

(58) Field of Classification Search ..... 2/144–151, 2/152.1, 153–157; 24/49.1, 57, 59, 62; 206/101, 206/278

See application file for complete search history.

(56) References Cited

U.S. PATENT DOCUMENTS 1,862,353 A * 6/1932 Allison ..... 206/278
3,511,364 A * 5/1970 Airdo ..... 206/278
4,046,253 A * 9/1977 Weaver ..... 206/278
4,173,792 A * 11/1979 Intengan ..... 2/144
5,673,434 A * 10/1997 Risk ..... 2/144
6,460,189 B1 * 10/2002 Welch ..... 2/145

* cited by examiner

*Primary Examiner*—Tejash Patel
(74) *Attorney, Agent, or Firm*—Darby & Darby

(57) ABSTRACT

Provided is a combination of clothing articles packaged for sale. The combination comprises a shirt having a shirt collar and a necktie disposed about the shirt collar. The necktie comprises a length of fabric having first and second ends and at least one fold intermediate the first and second ends. An elastic band passes transversely to the length of fabric within the fold and is sized to be stretchably received about the shirt collar. A clip is engaged with the fabric proximate to the fold. The clip pinches the fabric so as to emulate the appearance of a tie knot. Also provided are methods for packaging a necktie and shirt combination.

3 Claims, 1 Drawing Sheet

TIE AND SHIRT COMBINATION SECURED WITH AN ELASTIC BAND

FIELD OF THE INVENTION

The present invention relates generally to presenting items of clothing and specifically to presenting shirt and tie combinations.

BACKGROUND OF THE INVENTION

Retailers are discovering that shirt and tie combinations packaged together better meet the needs of a certain class of shoppers. When displaying and selling dress shirts in combination with ties, retailers assist their clients with a fashion choice that can be time consuming. Furthermore, when suitably coordinated, a shirt and a tie combination can make a more attractive display item for sale than if displayed individually.

Unfortunately, some consumers tend to remove and replace ties from their previously associated shirt, and thus create additional costs and difficulties to the retailer. Among other problems created, the individual components are not separately priced. Thus, retailers would benefit from a way to package shirt and tie combinations so that the consumer is discouraged from removing ties from these combinations.

An existing solution to this problem is to wrap the entire shirt and tie combination in a clear plastic bag. However, this solution proves unsatisfactory for consumers who wish to inspect the material of the shirt or tie by touching it. The present invention provides needed improvements in this field.

SUMMARY OF THE INVENTION

Provided is a shirt and tie combination. The combination comprises a shirt having a shirt collar and a necktie. The necktie is disposed about the shirt collar. The necktie comprises a length of fabric having first and second ends. A fold is placed between the first and second ends. The combination also comprises an elastic band and a clip. The elastic band is sized to be stretchably received about the shirt collar. It passes transversely to the length of fabric within the fold. The clip is engaged with the fabric proximate to the fold. It pinches the fabric so as to emulate the appearance of a tie knot.

In a further aspect of the present invention the elastic band passes continuously through the fold.

In yet another aspect the clip is generally U shaped. The clip comprises a base and two fingers extending from opposite ends of the base.

Also provided is a method for packaging a necktie and shirt combination. A shirt having a collar is obtained. Also obtained is a necktie comprising a length of fabric having first and second ends. The necktie is folded along a line transverse to the length of fabric and intermediate the first and second ends. Thus, at least one fold is created. The elastic band is positioned within that fold. The elastic band is then wrapped around the shirt collar. The necktie is pinched at a position proximate to the fold with a clip.

Also provided is a second method for packaging a necktie and shirt combination. A shirt having a collar is obtained. Also obtained is a necktie comprising a length of fabric having first and second ends. The necktie is knotted to create a knot. A channel is formed inside the knot, the channel being transverse to the length of fabric. The elastic band is positioned within that channel. The elastic band is then wrapped around the shirt collar.

DETAILED DESCRIPTION OF THE PREFERRED EMBODIMENTS

Figure 1:
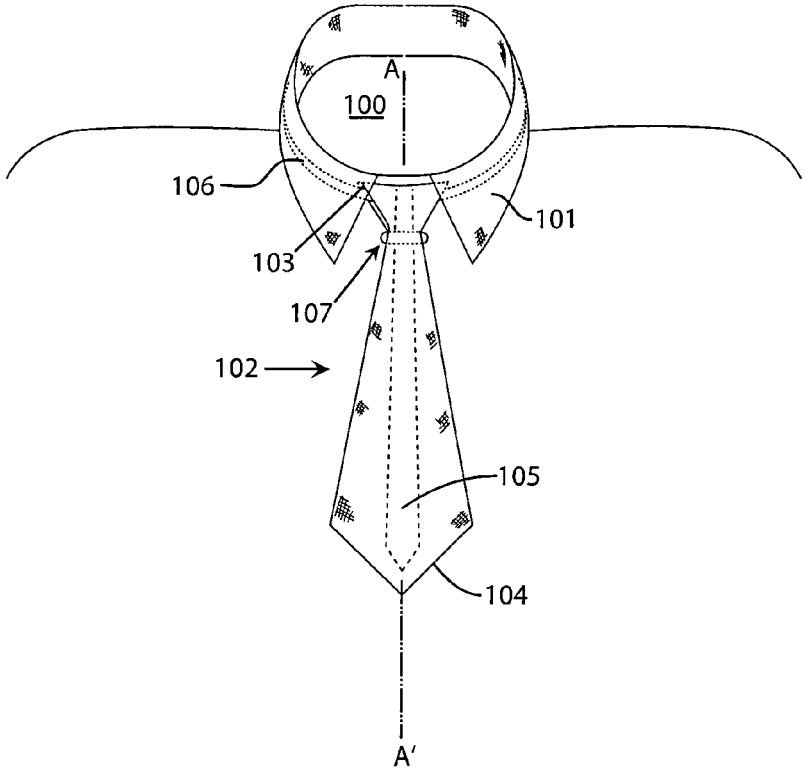
FIG. 1 is a front view of the shirt and tie combination.

FIG. 1 is a front view of a shirt and tie combination. The shirt 100 is preferably folded as shown. The shirt 100 includes a collar 101. A necktie 102 is also included. The necktie essentially comprises a length of fabric. It may be any suitable fabric such as silk. The necktie may also comprise a combination of fabrics. The fabric of the necktie generally extends in the vertical direction (along line A–A') as shown in FIG. 1. The necktie has a first end 104 and a second end 105.

The necktie 102 is folded between the first and second ends to create a fold 103. The fold is horizontal in FIG. 1, thus being in a direction transverse to that of the fabric of the necktie (namely, transverse to line A–A'). While only a single fold is shown, the necktie may be folded several times in order to achieve desirable length when packaged with the shirt. Furthermore, several folds may be oriented so as to define a knot.

An elastic band 106 is placed within the fold, or within at least one of the several folds if several are present. The elastic band 106 is preferably manufactured from rubber, but may be manufactured from an elastic fabric, or a flexible elastic plastic material. The elastic band 106 passes through the fold in a generally horizontal direction, i.e. direction transverse to that in which the necktie extends. The elastic end is resiliently stretched around the collar 101. Preferably, the elastic band is slightly shorter than the circumference of the collar thus necessitating it to be stretched when wrapped around the collar. Preferably, the elastic band passes continuously within the fold.

A clip 107 is placed on the necktie in a position proximate to the fold. The clip 107 is preferably placed about 1–1.5 inches below the fold. The clip pinches the necktie in order to create the appearance of a knot, as shown in FIG. 1. If a knot is already present, the clip is not required.

Figure 2:
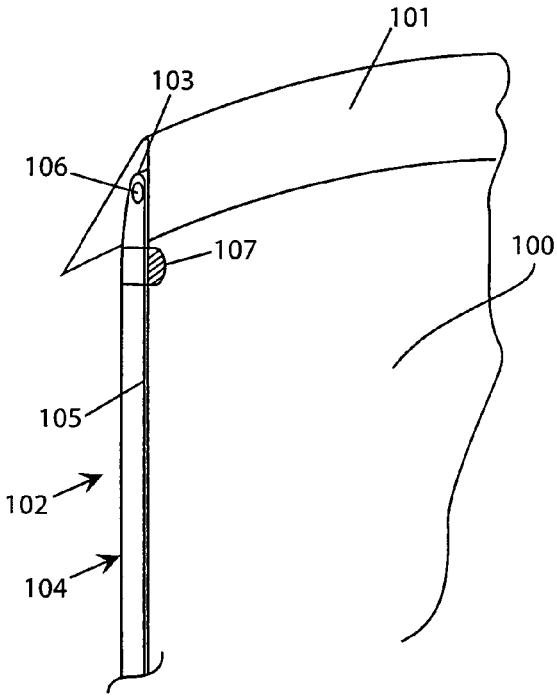
FIG. 2 is a side view of the shirt and tie combination as cut along line A–A'.

FIG. 2 is a side view of the shirt and tie combination as when cut along line A–A'. It is included to provide a more complete depiction of the elements discussed above. The clip is positioned so that the base is between the shirt and the necktie so as to be substantially concealed from view.

Figure 3:
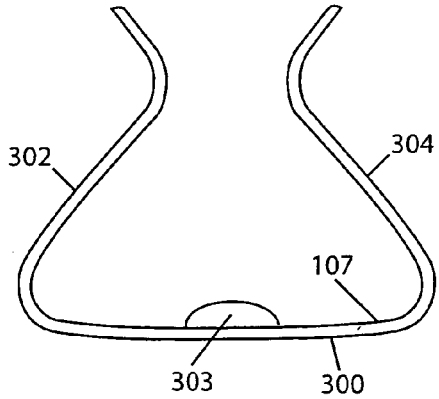
FIG. 3 is an end plan view of the clip.

FIG. 3 is an end plan view of the clip 107. As shown in FIG. 3, the clip is generally U-shaped. It comprises a base 300 and two legs 301 and 302. The legs are resiliently attached to the base at its opposite ends. A reinforcement 303 is also provided. It better prevents the base from breaking. Preferably, the base, the legs and the reinforcement are made from the same resilient material—plastic. Other materials, such as thin metals that are flexible, may be used instead.

In use, a necktie and shirt are packaged in combination by providing a shirt having a shirt collar and a necktie. The necktie is folded along a line transverse to the length of its fabric. An elastic band is positioned within the fold and wrapped around the shirt collar. The necktie can then be pinched at a position proximate to the fold with a clip. Alternatively or in addition, the tie can be knotted after the positioning step. In that case, the knot defines a channel transverse to the length of the fabric such that the elastic band can be disposed within the channel.

In another packaging method, a shirt is again provided as well as a necktie, with the necktie being knotted to create a knot. The knot is such that it features at least one channel transverse to the length of the fabric. An elastic band is positioned within the channel. The elastic band is wrapped around the shirt collar.

The invention has been described in connection with a particular embodiment thereof but is defined solely by the claims appended hereto.

What is claimed is:

1. A method for packaging a necktie and shirt combination, comprising the steps of:

providing a shirt having a shirt collar;

providing a necktie comprising a length of fabric having first and second ends;

folding the necktie along a line transverse to the length of fabric and intermediate the first and second ends, to create at least one fold;

positioning an elastic band within the fold;

wrapping the elastic band around the shirt collar; and pinching the necktie at a position proximate to the fold with a clip with the length of the fabric between the fold and the clip being exposed.

2. The method of claim 1, including the additional step of knotting the tie after the positioning step, wherein the knot defines a channel transverse to the length of the fabric and wherein the elastic band is further disposed within the channel.

3. A method for packaging a necktie and shirt combination, comprising the steps of:

providing a shirt having a shirt collar;

providing a necktie comprising a length of fabric having first and second ends;

knotting the necktie to create a knot with a channel therein, the channel being transverse to the length of fabric;

positioning an elastic band within the channel; and wrapping the elastic band around the shirt collar.

* * * * *